United States Patent [19]

Baumber et al.

[11] Patent Number: 4,725,463

[45] Date of Patent: Feb. 16, 1988

[54] SELECTIVELY FOLDABLE ELONGATED MEMBER

[75] Inventors: Kevin G. Baumber; Donald E. Baumber, both of South Hurstville, Australia

[73] Assignee: ULV Pty. Limited, Australia

[21] Appl. No.: 835,888

[22] Filed: Mar. 4, 1986

[30] Foreign Application Priority Data

Mar. 5, 1985 [AU] Australia ..... PG9570

[51] Int. Cl.[4] ..... B32B 7/06; B65D 5/26

[52] U.S. Cl. ..... 428/33; 16/225; 16/319; 16/366; 16/DIG. 13; 220/62; 220/339; 428/35; 428/99; 428/121; 428/542.8

[58] Field of Search ..... 220/62, 339; 16/DIG. 13, 225, 319, 366; 24/297, 543; 49/498; 428/35, 100, 121, 124, 542.8, 99

[56] References Cited

U.S. PATENT DOCUMENTS

| | | | |
|---|---|---|---|
| 1,958,131 | 5/1934 | Davidson | 156/79 |
| 2,204,622 | 6/1940 | Reid | 156/79 |
| 2,881,717 | 4/1959 | Fuller | 52/100 |
| 3,207,357 | 9/1965 | Schmitt | 428/542.8 X |
| 3,241,280 | 3/1977 | Kreuzer | 52/311 |
| 3,459,870 | 8/1969 | Plummer | 428/99 X |
| 3,527,013 | 9/1970 | Kruschwitz | 428/122 X |
| 3,649,398 | 3/1972 | Keith | 428/122 X |
| 3,654,053 | 4/1972 | Toedter | 428/76 X |
| 3,900,550 | 8/1975 | Oliver et al. | 220/339 X |
| 3,907,193 | 9/1975 | Heller | 220/339 X |
| 4,010,865 | 3/1977 | Wilgus | 428/12 X |
| 4,235,346 | 11/1980 | Liggett | 220/339 X |
| 4,463,046 | 7/1984 | Hutchison et al. | 428/126 X |

FOREIGN PATENT DOCUMENTS

| | | |
|---|---|---|
| 0656157 | 3/1965 | Belgium . |
| 0097022 | 12/1983 | European Pat. Off. . |
| 1170255 | 9/1958 | France . |
| 1382560 | 11/1964 | France . |

*Primary Examiner*—Henry F. Epstein
*Attorney, Agent, or Firm*—Sandler & Greenblum

[57] ABSTRACT

An elongated handle which is foldable to form a package, said handle being formed from a strip divided longitudinally by a plurality of spaced longitudinally extending hinges enabling bending of the strip to provide said handle with a desired configuration, and a plurality of transversely extending hinges enabling folding of said strip to form said package.

27 Claims, 9 Drawing Figures

SELECTIVELY FOLDABLE ELONGATED MEMBER

BACKGROUND OF THE INVENTION

1. Field of the Invention

The present invention relates to elongated members which are generally rigid and are used for handles, supports, legs or arms.

2. Discussion of Background of Information

Elongated handles and supports members for temporary structures, are generally cumbersome to store and transport. In addition these members are difficult to vend due to their elongated nature. Moreover, if the elongated member requires packaging, the packaging is generally expensive, again due to the elongated nature of the member.

SUMMARY OF THE INVENTION

It is the object of the present invention to overcome or substantially ameliorate the above disadvantages.

In accordance with the present invention a selectively foldable elongated member with longitudinal sides is provided by a strip divided longitudinally by a plurality of transversely spaced longitudinally extending hinges. The longitudinal sides extend between adjacent hinges, so that the sides can pivot relative to each other to provide the member with a desired predetermined transverse cross section. The strip also has hinges extending transverse of the strip enabling so that the strip can fold about the transverse hinges.

BRIEF DESCRIPTION OF DRAWINGS

A preferred form of the present invention will now be described by way of example with reference to the accompanying drawings, wherein.

DETAILED DESCRIPTION

Figure 1:
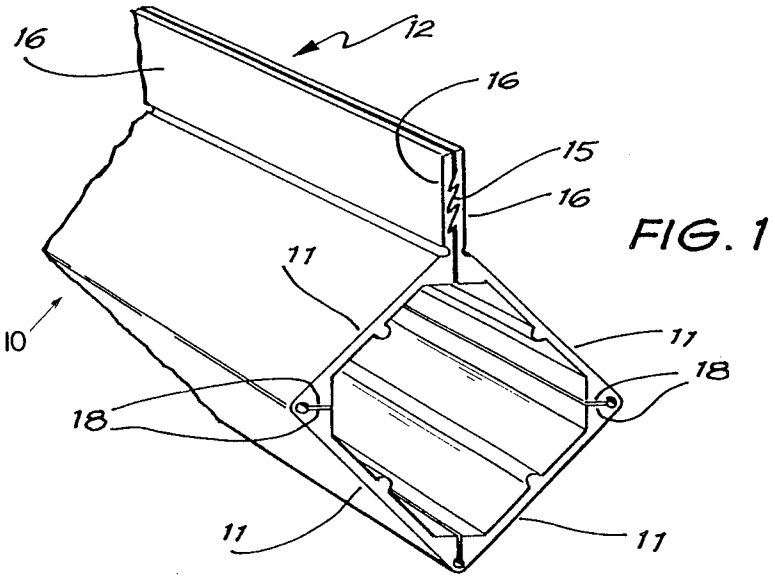
FIG. 1 is a schematic perspective view of a portion of an elongated foldable member.

In FIG. 1 there is schematically depicted a generally rigid member 10. The rigid member 10 has a cross section providing a plurality of sides 11 together with a ridge 12. It should be appreciated that the member 10 of the embodiment of FIG. 1 is merely provided with four sides, however the present invention is applicable to an elongated member having two, three or more sides. If two sides are employed, the sides need to be curved in transverse cross-section.

Figure 2:
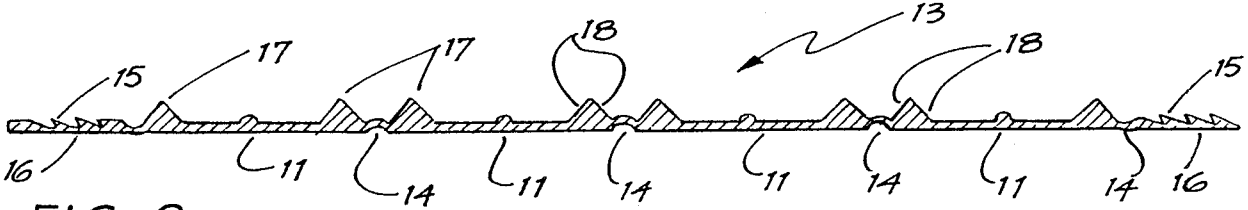
FIG. 2 is a schematic transverse cross section of a strip foldable to form the member of FIG. 1.
Figure 3:
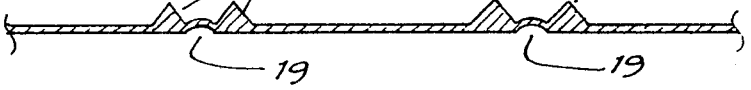
FIG. 3 is a schematic longitudinal section of a portion of the strip of FIG. 2.

Turning now to FIGS. 2 and 3, which depict a strip 13 to be used to form the member 10. The strip 13 is provided with a plurality of transversely spaced longitudinally extending hinges 14 enabling bending of the strip 13 about longitudinal axes to form the member 10. Each side 11 extends between a pair of adjacent hinges 14. The two longitudinally extending edge portions 16 of the strip 13 are provided with a plurality of interlocking bars 15 which co-operate to secure the two edge portions 16 together to form the ridge 12.

The strip 13 is also provided with transversely spaced longitudinally extending ridges 17, with each ridge 17 being provided with a pair of inclined sides 18. The angle defined by the two sides 18 is determined by the number of sides the member 10 is provided with. When the strip 13 is bent or folded about the longitudinal axes defined by the hinges 14, to form the member 10, the surfaces 18 abut as seen in FIG. 1. In the configuration of FIG. 1, the member 10 has sufficient rigidity to inhibit squashing or bending.

Figure 8:
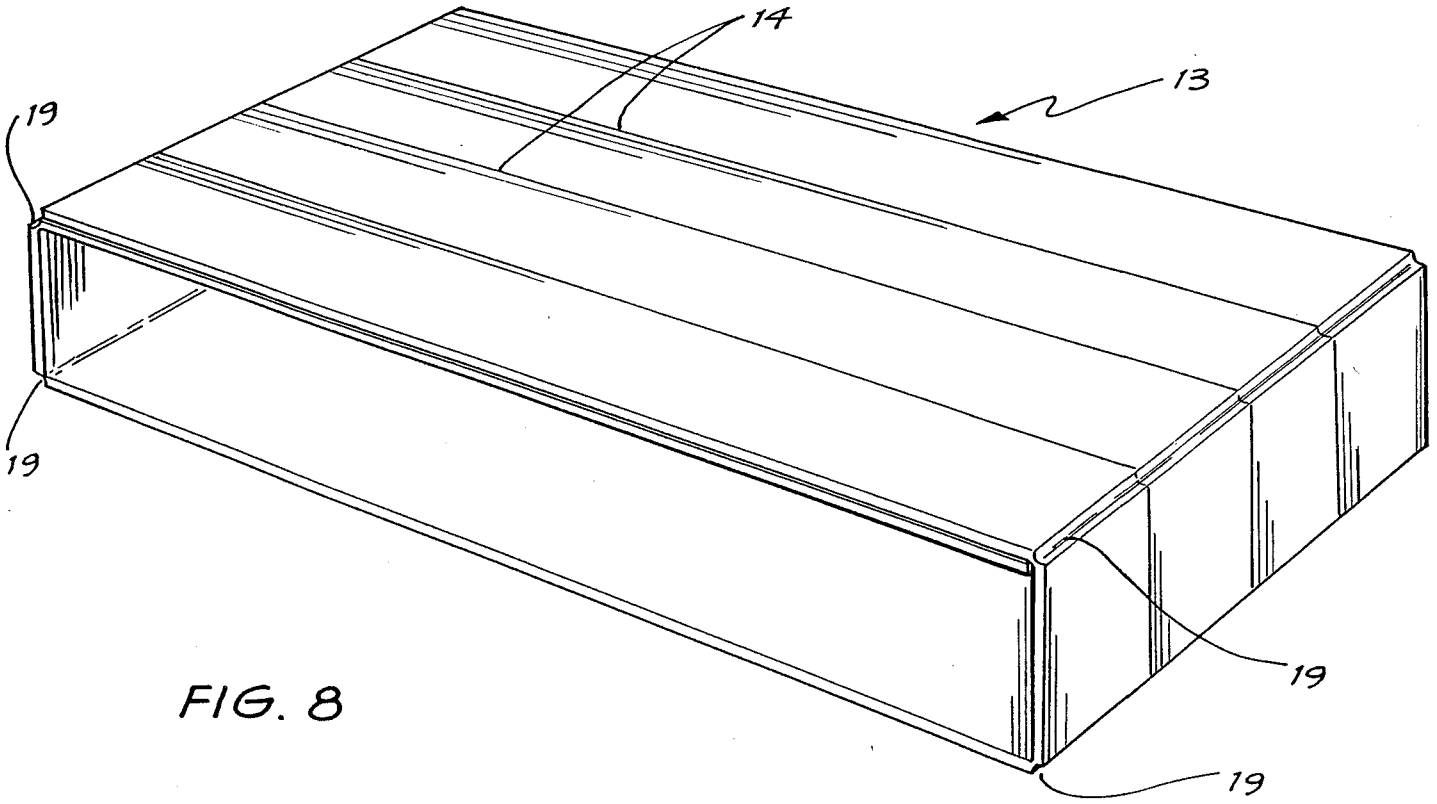
FIG. 8 is a schematic perspective view of any one of the strips of FIGS. 2 to 7 folded about transverse axes.

As best seen in FIG. 3, the strip 13 is also provided with hinges 19 which extend transverse of the strip 13. The hinges 19 enable bending of the strip 13 about axes extending transverse thereof so that the strip 13 may be bent to a configuration generally depicted in FIG. 8. Alternatively, the hinges 19 may be spaced so that the strip 13 could be bent about several transverse axes so as to divide the strip into sections which lie one upon the other. By providing these transverse hinges 19, the strip 13 may be bent to the configuration depicted in FIG. 8, whereat the strip 13 provides a package within which articles to be used with the member 10 may be stored for retail and transportation purposes. Again, there may be associated with each hinge 19, transverse ridges 20 which may abut to provide the desired configuration, as depicted in FIG. 8. The ridges 20 would interact in the same manner as the ridges 17 described with reference to FIG. 2.

Figure 4:
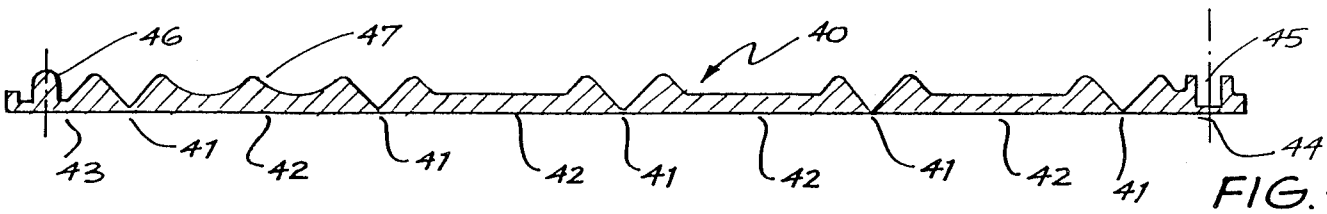
FIG. 4 is a schematic transverse cross section of a further strip foldable to form the member of FIG. 1.

Turning now to the embodiment depicted in FIG. 4 wherein there is schematically depicted a strip 40 which may be bent or folded about several longitudinal axes to provide a similar member to the member 10. The strip 40, as depicted in FIG. 4, is provided with a plurality of transversely spaced longitudinally extending hinges 41 joining the sides 42. However in this particular embodiment, the strip 40 is provided with edge portions 43 and 44, with the edge portion 44 being provided with a plurality of holes 45 at longitudinally spaced locations along the edge portion 44. The edge portion 43 is provided with projections 46 which are spaced so as to be transversely aligned with the holes 45. The projections 46 are also of a configuration to be snap engaged or interference fitted into the holes 45. Accordingly, when the strip 40 is bent or folded about the hinges 41, the edge portions 43 and 44 are secured together to provide a ridge, similar to the ridge 12 of FIG. 1. Still further, one or more of the sides 42 may be corrugated so as to provide additional ridges 47 to add to the rigidity of the strip 40. By providing the ridges 47, the first moment of inertia of the strip 40 about an axis transverse of the strip 40 but generally aligned within the plane thereof, is increased. Additionally, each side 42 may also be provided with diagonal ribs to inhibit twisting of the elongated member.

Figure 5:
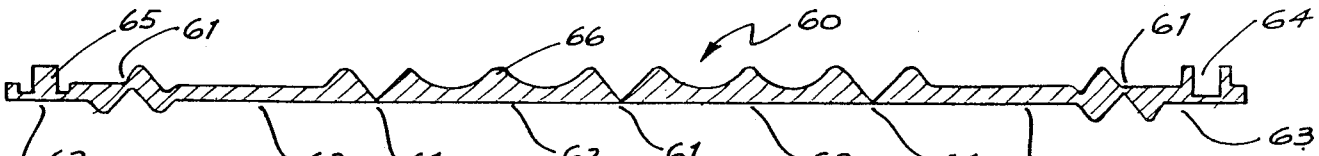
FIG. 5 is a schematic transverse cross section of a still further strip to form the member of FIG. 1.

In FIG. 5 there is schematically depicted a strip 60, with the strip 60 also provided with hinges 61. The hinges 61 pivotally attach sides 62 with the strip 60 also provided with edge portions 63 extending longitudinally of the strip 60. This strip 60 is of a similar configuration to the strip 40, with the edge portions 63 provided with transversely aligned holes 64 and projections 65 which co-operate to hold the strip 60 in a configuration similar to FIG. 1. Again the strip 60 is provided with corrugations 66 to provide each side 62 with added rigidity.

Figure 6:
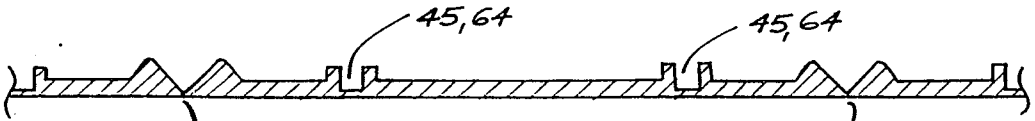
FIG. 6 is a schematic longitudinal cross section of a portion of the strip of FIG. 4 or 5.
Figure 7:
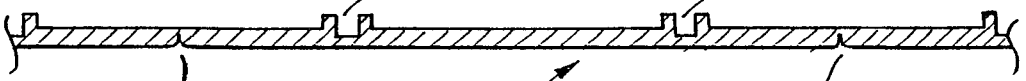
FIG. 7 is a schematic longitudinal section of a portion of the strip of FIG. 4 or 5.

In FIGS. 6 and 7 there is schematically depicted longitudinal sections of portions of the strips of FIGS. 4 and 5. For example with reference to FIG. 6, the strip 40 or 60 could be provided with transversely extending hinges 70 to enable the strip to be bent or folded as best seen in FIG. 7. Additionally, there are provided holes 45 or 64 as described with reference to FIGS. 4 and 5. In FIG. 7, the hinges 71 are merely slits cut in the strip 72 rather than formed or V-shaped hinges as described with reference to FIG. 6. In FIG. 7 the hinges 71 extend transverse of the strip 72, and again the strip is provided with the holes 45, 64 as described with reference to FIGS. 4 and 5.

The various strips described with reference to FIGS. 1 to 8 may be formed of extruded plastics material or alternatively may be made from plastics material deformed by hot rollers. The rollers could be employed to form the longitudinally extending deformations as well as the transverse deformations. As an alternative construction, the various strips may be formed of a laminated structure with the rigidity being provided by a more rigid material rather than an additional material fixed thereto and which provides the various hinges.

Figure 9:
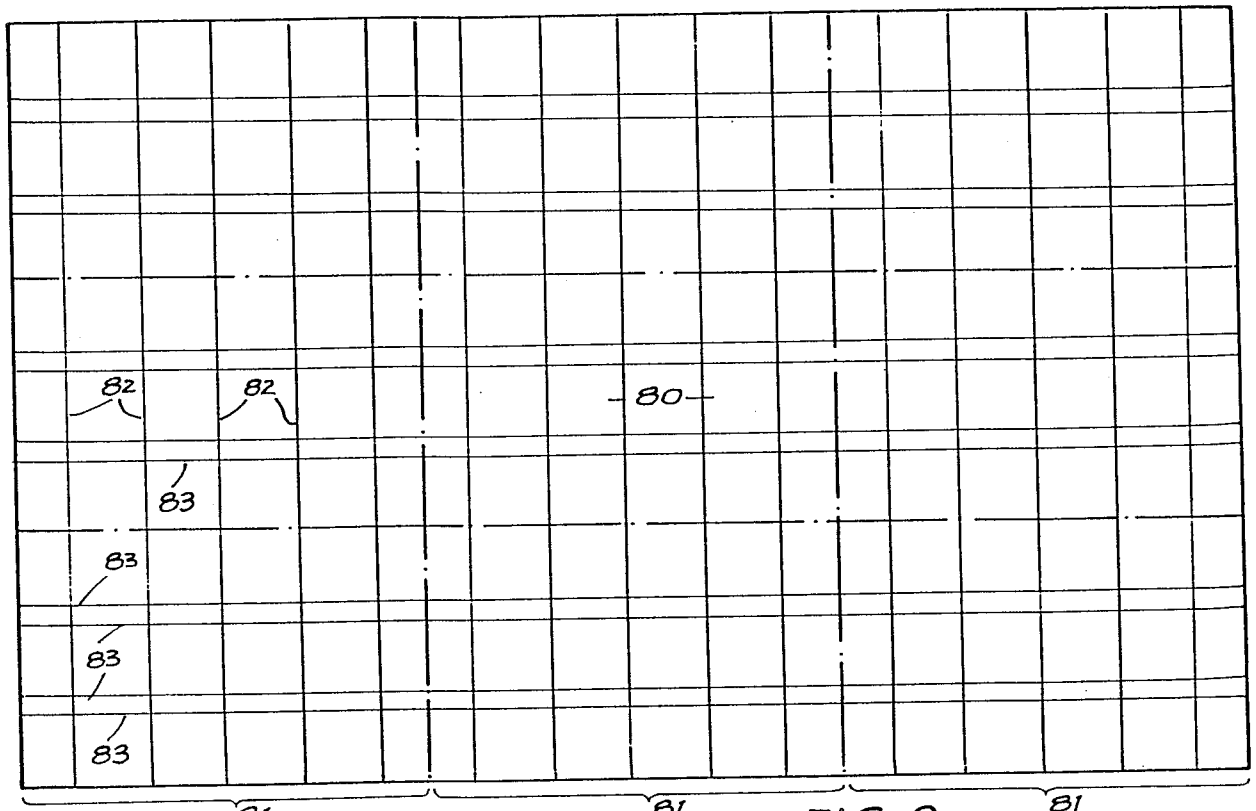
FIG. 9 is a schematic plan view of a method of manufacturing the strips of FIGS. 1 to 8.

In FIG. 9 there is schematically depicted a sheet 80 of plastic material to provide a plurality of strips as described previously. The strips 81 have longitudinal hinges 82 and transverse hinges 83. The sheet 80 can be cut to provide a desired number of strips 81. From the foregoing description, one skilled in the art can easily ascertain the essential characteristics of this invention and, with departing from the spirit and scope thereof, make various changes and modifications of the invention to adapt to various usages and conditions.

What we claim is:

1. A selectively foldable member with longitudinal sides, said member comprising a strip divided longitudinally into at least two sides by at least one transversely spaced longitudinally extending hinge, said sides extending from said at least one hinge thereby adapting said sides to pivot relative to each other so as to provide said member with a desired predetermined transverse cross-section, each of said sides being divided transversely by at least one transverse hinge thereby adapting said sides to be folded about said transverse hinge.

2. The foldable member of claim 1, wherein said strip has longitudinally extending edges and a margin portion extending along each of said edges, and wherein said margin portions are adapted to be secured together to retain said member in said predetermined transverse cross-section.

3. The foldable member of claim 2, wherein each said longitudinally extending hinge is defined by diverging surfaces extending longitudinally along said sides, said diverging surfaces being adapted to abut when the member is folded into said predetermined transverse cross-section.

4. The foldable member of claim 1, wherein said transverse hinges divide said sides into segments enabling said strip to be folded to form a package.

5. The foldable member of claim 1, wherein said strip is made from plastic material.

6. The foldable member of claim 2, wherein said margin portions are provided with a plurality of means for securing said margin portions together by retaining said member in said predetermined transverse cross-section.

7. The foldable member of claim 6, wherein said means for securing are barbs adapted to fit together in a locking fashion.

8. The foldable member of claim 6, wherein said means for securing are a plurality of oppositely aligned recesses and projections adapted to fit firmly together in a locking fashion.

9. The foldable member of claim 3, wherein each of said sides is provided with longitudinally extending ridges having a pair of inclined sides adjacent each said longitudinally extending hinge.

10. The foldable member of claim 9, wherein adjacent inclned sides of said ridge are adapted to abut when said sides are pivoted about said longitudinally extending hinge to define said transverse cross-section and to provide rigidity to the resultant folded member.

11. The foldable member of claim 9, wherein each of said sides is provided with transversely extending ridges having a pair of inclined sides adjacent each of said longitudinally spaced transverse hinges.

12. The foldable member of claim 11, wherein adjacent inclined sides of said ridges abut when said sides are folded about said transverse hinge.

13. The foldable member of claim 1, wherein at least one of said sides is corrugated.

14. The foldable member of claim 1, wherein at least one of said sides is provided with diagonal reinforcement ribs.

15. A selectively foldable member with longitudinal sides, said member comprising a strip divided longitudinally into at least two sides by at least one transversely spaced longitudinally extending hinge, said sides being provided with longitudinally extending ridges having a pair of inclined sides adjacent each said longitudinally extending hinge, said sides extending from said at least one hinge thereby adapting said sides to pivot relative to each other so as to provide said member with a desired predetermined cross-section, each of said sides being divided transversely by at least one transverse hinge thereby adapting said sides to be folded about said transverse hinge.

16. The foldable member of claim 15, wherein said strip has longitudinally extending edges and a margin portion extending along each of said edges, and wherein said margin portions are adapted to be secured together to retain said member in said predetermined transverse cross-section.

17. The foldable member of claim 16, wherein each said longitudinally extending hinge is defined by diverging surfaces extending longitudinally along said sides, said diverging surfaces being adapted to abut when the member is folded into said predetermined transverse cross-section.

18. The foldable member of claim 15, wherein said transverse hinge divides said sides into segments enabling said strip to be folded to form a package.

19. The foldable member of claim 16, wherein said margin portions are provided with a plurality of means for securing said margin portions together by retaining said member in said predetermined transverse cross-section.

20. The foldable member of claim 19, wherein said means for securing are barbs adapted to fit together in a locking fashion.

21. The foldable member of claim 19, wherein said means for securing are a plurality of oppositely aligned recesses and projections adapted to fit firmly together in a locking fashion.

22. The foldable member of claim 15, wherein adjacent inclined sides of said ridge are adapted to abut when said sides are pivoted about said longitudinally extending hinge to define said transverse cross-section and to provide rigidity to the resultant folded member.

23. The foldable member of claim 15, wherein each of said sides is provided with transversely extending ridges having a pair of inclined sides adjacent said longitudinally spaced transverse hinge.

24. The foldable member of claim 23, wherein adjacent inclined sides of said ridges abut when said sides are folded about said transverse hinge.

25. The foldable member of claim 15, wherein at least one of said sides is corrugated.

26. The foldable member of claim 15, wherein at least one of said sides is provided with diagonal reinforcement ribs.

27. The foldable member of claim 15, wherein said strip is made from plastic material.

* * * * *